US009016508B1

(12) United States Patent
Leighton et al.

(10) Patent No.: US 9,016,508 B1
(45) Date of Patent: Apr. 28, 2015

(54) CONTAINER WITH MOVABLE BOTTOM PLATE

(71) Applicants: Joseph Paul Leighton, Providence, RI (US); Richard Desmarais, N. Smithfield, RI (US)

(72) Inventors: Joseph Paul Leighton, Providence, RI (US); Richard Desmarais, N. Smithfield, RI (US)

(73) Assignee: Joseph Paul Leighton, Narragansett, RI (US)

( * ) Notice: Subject to any disclaimer, the term of this patent is extended or adjusted under 35 U.S.C. 154(b) by 0 days.

(21) Appl. No.: 14/071,699

(22) Filed: Nov. 5, 2013

Related U.S. Application Data

(60) Provisional application No. 61/722,583, filed on Nov. 5, 2012.

(51) Int. Cl.
*B65D 6/16* (2006.01)
*B65D 25/06* (2006.01)

(52) U.S. Cl.
CPC ..... *B65D 11/18* (2013.01)

(58) Field of Classification Search
CPC ..... B65D 25/06; B65D 25/04
USPC ..... 220/630, 628, 545, 546, 544, 532, 530, 220/529; 215/3
See application file for complete search history.

(56) References Cited

U.S. PATENT DOCUMENTS

| | | | | | |
|---|---|---|---|---|---|
| 1,414,911 | A | * | 5/1922 | Watson | 248/146 |
| 1,933,596 | A | * | 11/1933 | Showles | 426/115 |
| 2,751,126 | A | | 6/1956 | Chandler | |
| 4,044,912 | A | | 8/1977 | Nichols | |
| 4,298,036 | A | | 11/1981 | Horvath | |
| 4,819,836 | A | | 4/1989 | Meckenstock | |
| 4,951,848 | A | | 8/1990 | Keller | |
| 5,356,037 | A | | 10/1994 | Harrold | |
| 5,732,848 | A | | 3/1998 | Grab et al. | |
| 5,746,357 | A | | 5/1998 | Beveridge et al. | |
| 5,833,382 | A | | 11/1998 | Jenks et al. | |
| 6,136,352 | A | * | 10/2000 | Silverstein et al. | 426/115 |
| 7,399,017 | B1 | | 7/2008 | Lasseigne | |
| 8,157,114 | B2 | | 4/2012 | Baylous et al. | |
| 2005/0252384 | A1 | * | 11/2005 | Allard et al. | 99/324 |

* cited by examiner

*Primary Examiner* — Robert J Hicks
(74) *Attorney, Agent, or Firm* — Barlow, Josephs & Holmes, Ltd.

(57) ABSTRACT

A container has a movable bottom plate to facilitate dispensing material from the container and accessing material remaining within the container. The container has an inner chamber, further having an upper inner chamber and a lower inner chamber. The bottom plate slidably engages the inner surface of the inner chamber. A user can reach a handle on the bottom plate through an aperture at the bottom end of the container. The bottom plate is a plunger that can be moved from a lower inner chamber of the container to an upper inner chamber to remove material from the container. The bottom plate can be moved from the lower end towards the upper end of the container to dispense a product or to expel air from the container through vents positioned on the bottom plate and on the container wall towards the upper end of the container.

4 Claims, 17 Drawing Sheets

CONTAINER WITH MOVABLE BOTTOM PLATE

CROSS REFERENCE TO RELATED APPLICATION

This application is related to and claims priority to earlier filed U.S. provisional patent application 61/722,583, filed Nov. 5, 2012, the entire contents of which are incorporated herein by reference.

BACKGROUND

The instant invention relates to containers for dispensing and storing a product. More particularly, the invention relates to containers for products that react with air.

Various spreadable or flowable products, such as glue, grout or other construction materials, may be packaged in a sealable bucket. A user may wish to use only a small amount of the product at a time, and store the rest for later. In this situation, the user removes some product for use, and reseals the container. In a conventional container, air fills the void left by the removed material. For products that dry when exposed to air, this can cause the product to dry entirely or partially within the bucket before the user is ready to use the product again, resulting in wasted product. Additionally, when the bucket is deep, it will become difficult for a user to completely empty the container, as the last remnants of the product can be hard to reach at the bottom of the bucket. This is especially true when the user is trying to remove the material with a large tool relative to the opening of the bucket. Therefore, there is a need for a bucket that allows a user to advance the spreadable or flowable product within the bucket and easily minimize the amount of air within the bucket during storage of a product.

BRIEF SUMMARY OF THE INVENTION

The instant invention provides a container having a bottom plate that can slide within the container to dispense a product from the container and to adjust the height of the product within the container and the amount of air in contact with the product within the container when the container is resealed.

The container has an upper portion adjacent to an upper end and a lower portion adjacent to a lower end. An outer container wall defines an inner chamber, which further has an upper inner chamber and a lower inner chamber.

A retaining ring is positioned at the lower portion of the container, and, in some embodiments, at the lower end of the container. An aperture is defined within the retaining ring so that a user can extend an arm through the aperture to reach and push the bottom plate.

To allow a user to more easily grip the bottom plate and push it upwardly within the container, the bottom plate can be configured as a plunger with an attached handle on its lower surface. The bottom plate is configured to slidably engage the inner surface of the inner chamber as it moves from the retaining ring at the lower end of the container towards the upper end of the container. The bottom plate has a diameter that is smaller than the diameter of the container. To provide a firm seal with the inner wall of the inner chamber, the bottom plate has an O-ring adjacent to a peripheral edge of the bottom plate, and a liner extends over the interior wall of the container, between the interior wall and the O-ring.

As the bottom plate moves upwardly within the container, a ratcheting mechanism allows the bottom plate to be firmly seated within the container at various heights. By pushing on the bottom plate, the user can move the bottom plate from the lower inner chamber to the upper inner chamber in a single continuous motion, or in small increments. The ratcheting mechanism may be notches formed along the inner wall of the container, the notches being tapered so that each notch has a flat upper wall and an adjacent side wall that tapers downwardly and outwardly.

Thus, the bottom plate can be moved from the lower inner chamber to the upper inner chamber to dispense material from the container or to expel air from the container.

The container has air vents that allow air to be expelled from the inner chamber by upwards movement of the bottom plate. The air vents are formed separately from the opening formed in the upper end of the container for dispensing the product.

A catch is formed near the upper end of the container to lock flush the bottom plate to the top end of the container, forming an even surface extending along the top end of the container and the top surface of the bottom plate to facilitate extruding material from the container.

A lid can be provided with the container for sealing the upper end of the container.

The container has a handle having a middle region that is useful for engaging a surface to help stabilize the container when the product is being dispensed.

Accordingly, among the objects of the instant invention are: the provision of a unique and novel container in which the bottom plate movable and slidably engages an interior surface of the container to facilitate convenient and easy access and removal of material from the container. Another object of the invention is to provide a container having a bottom plate that engages a ratcheting mechanism along the interior wall of the container so that the bottom plate can be supported at various heights within the container. Another object of the invention is to provide a container having a movable bottom plate for reducing the air volume within the container after some of a product has been dispensed from the container. Another object of the present invention is to provide a container that has vents that are separate from the dispensing opening, and independently sealable from the sealable dispensing opening, so that the dispensing aperture may be sealed to contain the dispensable product within the container while air is vented from the container.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated of carrying out the present invention.

DESCRIPTION OF THE PREFERRED EMBODIMENT

Figure 1:
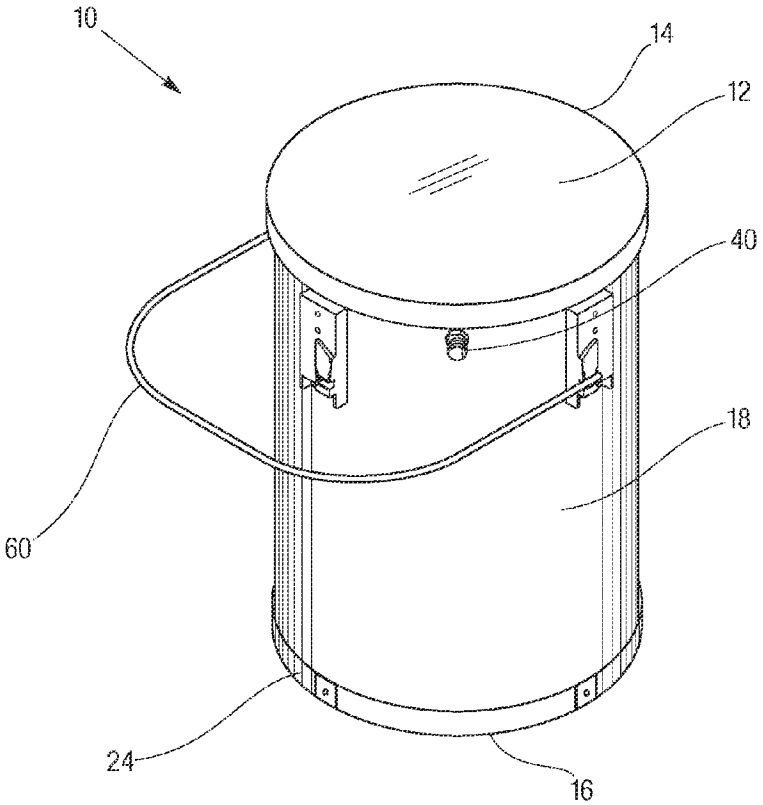
FIG. 1 is a perspective view of a first embodiment of the container of the present invention.
Figure 2:
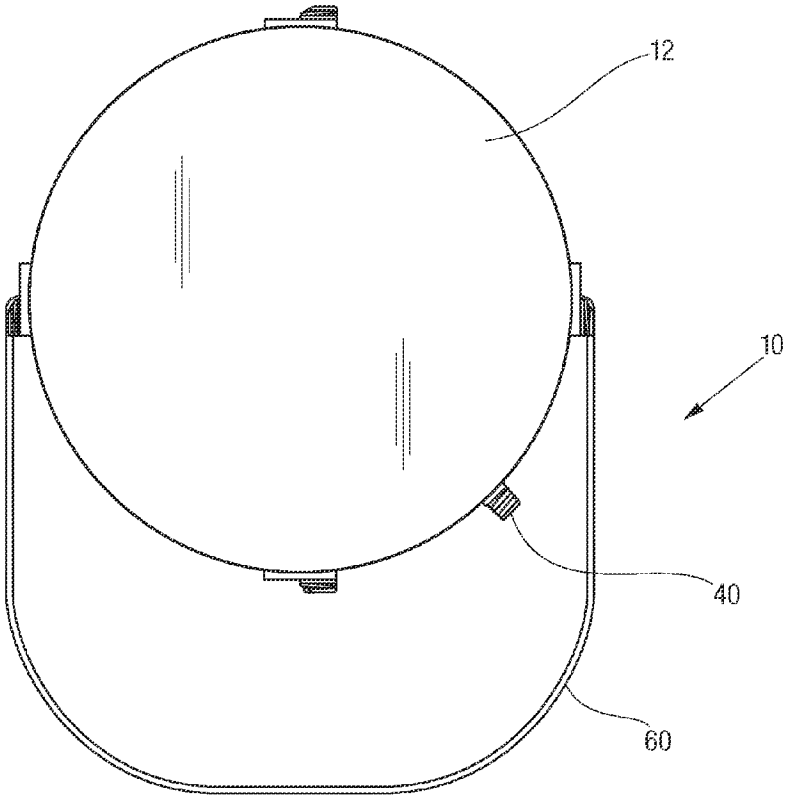
FIG. 2 is a top view thereof.
Figure 3:
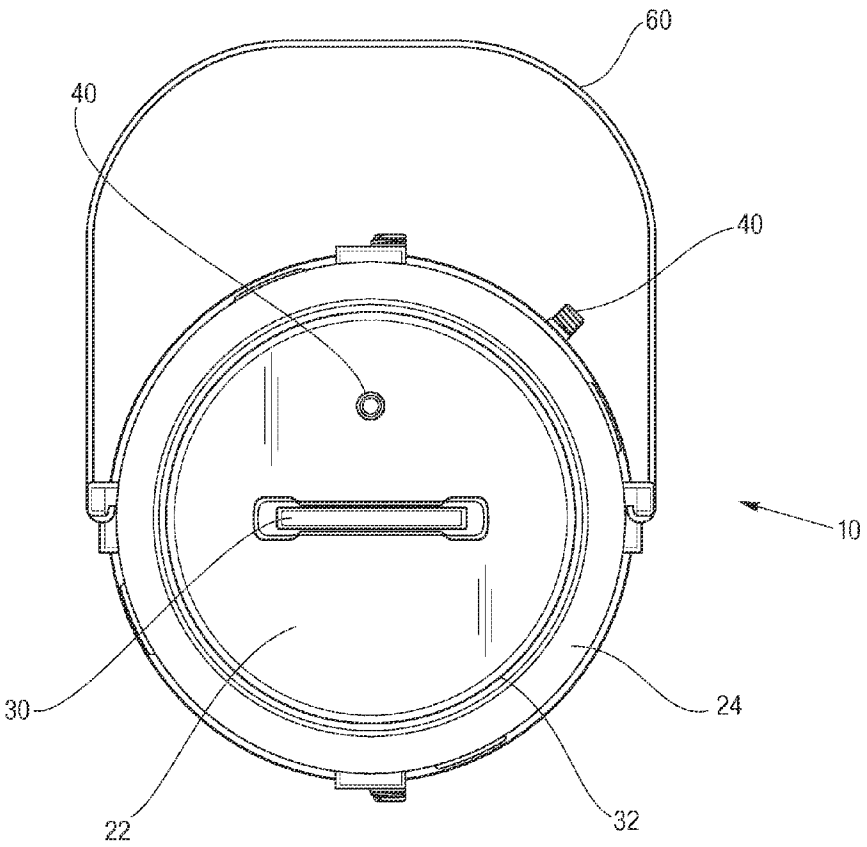
FIG. 3 is a bottom view thereof.
Figure 4:
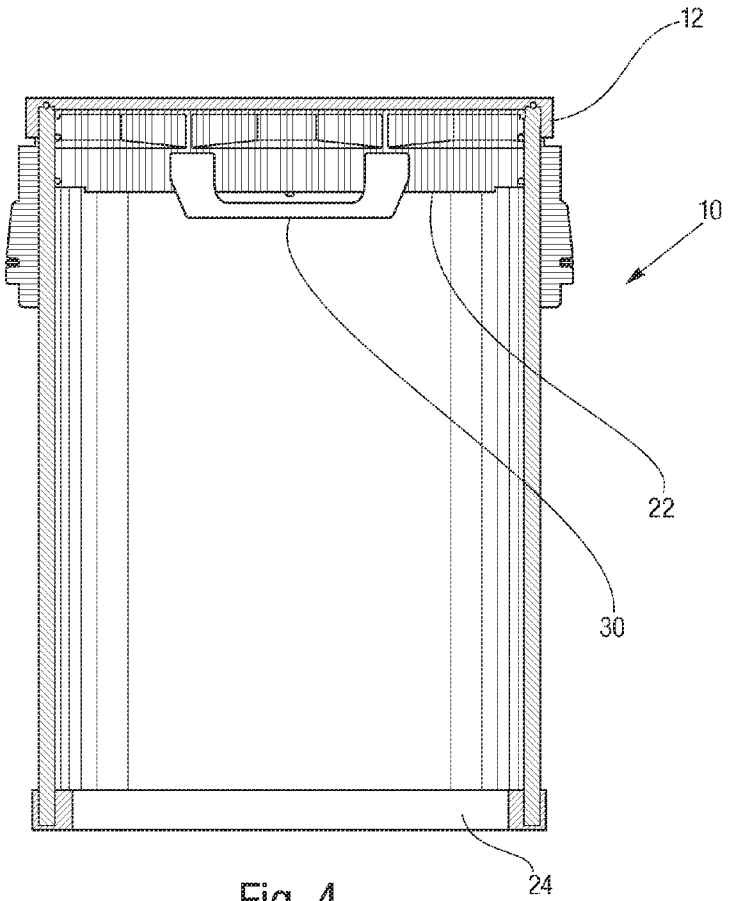
FIG. 4 is a sectional view thereof.
Figure 5:
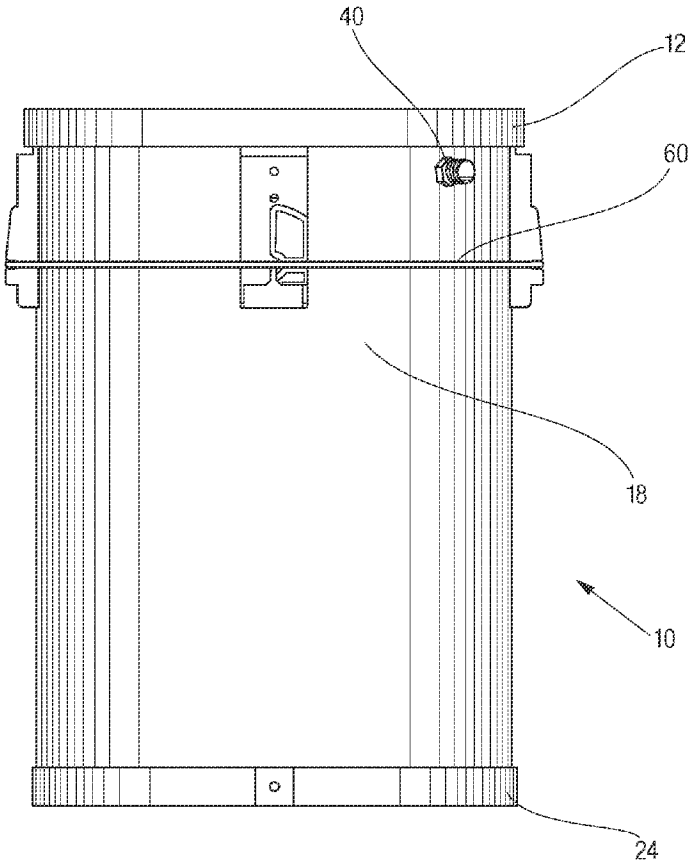
FIG. 5 is a front view thereof.

Referring now to the drawings, the container with movable bottom plate of the instant invention is illustrated and generally indicated at 10 in FIGS. 1-17. As will hereinafter be more fully described, the instant invention provides a container with a movable bottom plate for expelling air from the container and for making a product within the container more easily accessible.

In FIGS. 1-17 there is shown the container with a movable bottom plate comprising a lower portion and an upper portion. The lower portion of the container includes a retaining ring for engaging a bottom plate before the bottom plate is moved towards an upper portion of the container.

As seen in FIGS. 1-6, the exemplary embodiment of the container 10 defines an overall cylindrical shape, but of course this is merely an example, and the container may define other shapes and sizes. In one embodiment, the shape of the container may be, for example, square or rectangular. Still further, the container may be perforated or deemed collapsible by design to reduce the space of the container in waste receptacles and also promote the recycling of the container material.

In one embodiment, the upper portion of the container 10 has a lid 12 at an upper end thereof. FIG. 1 shows the container 10 having the lid 12 secured to the upper end of the container 10 to seal the container. Of course, it is contemplated that the upper end or lower end of the container 10 has a lid 12, both the upper end 14 and lower end 16 have lids, or there is no lid at either the upper end 14 or the lower end 16 of the container 10. For example, a container may have one lid 12. Alternatively, the container 10 has no lids with just a retainer ring, bottom or upper plate and a closed end.

Figure 6:
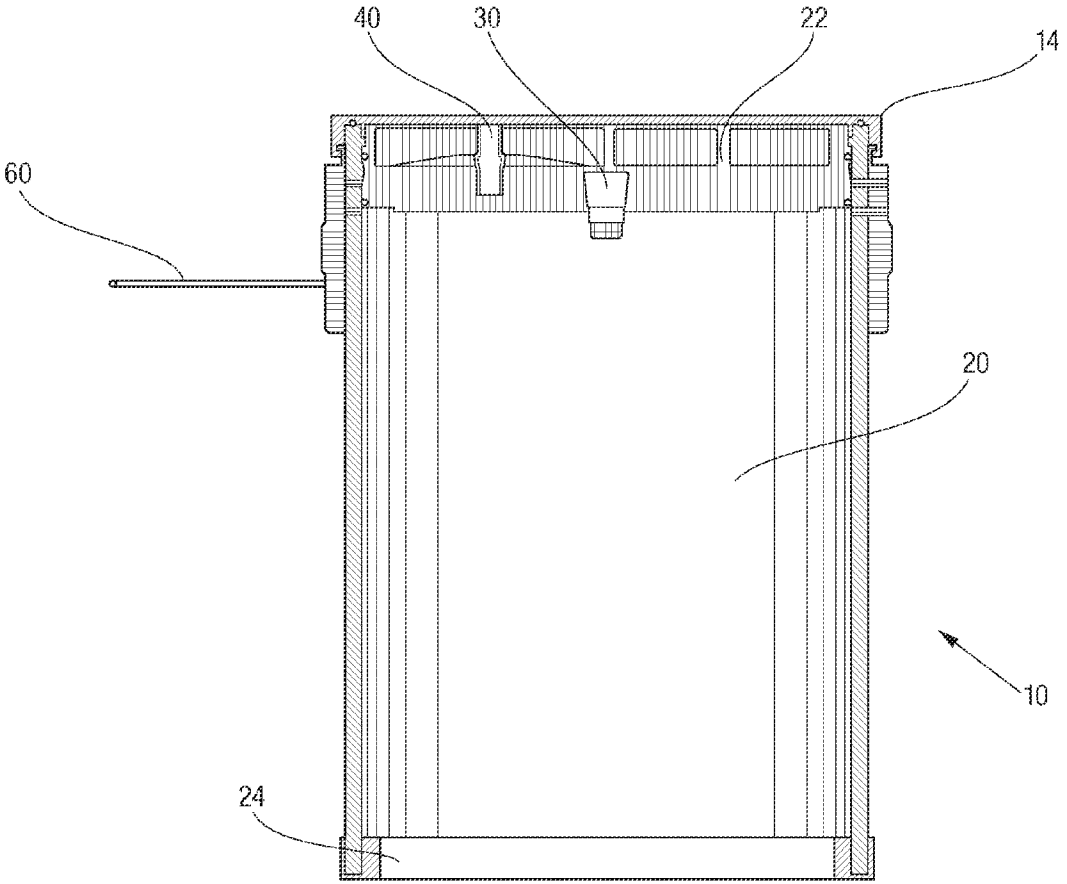
FIG. 6 is a sectional view thereof, with the bottom plate towards the upper end of the container.
Figure 11:
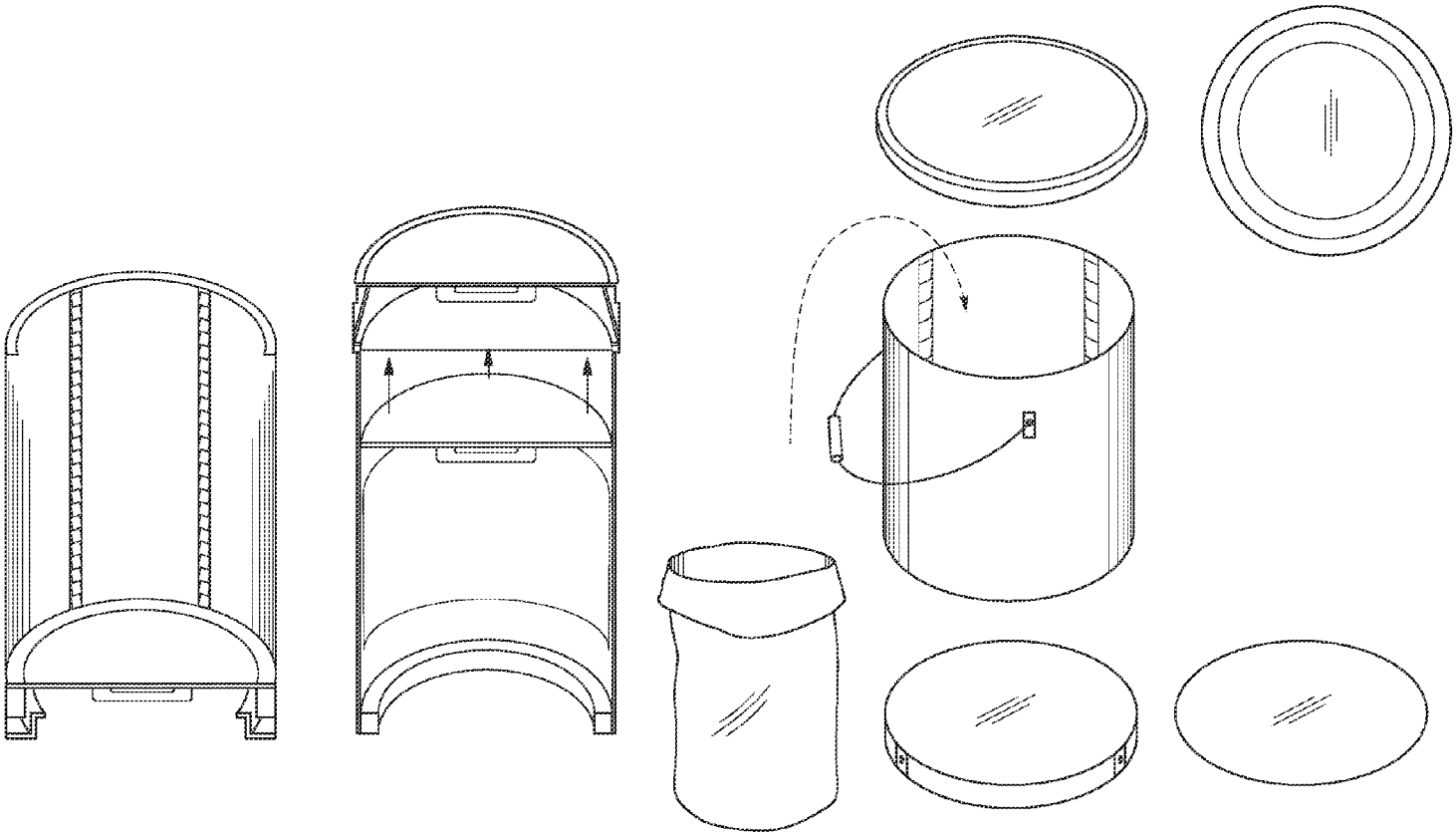
FIGS. 11-15 are artistic renderings of a second embodiment of the present invention.
Figure 13:
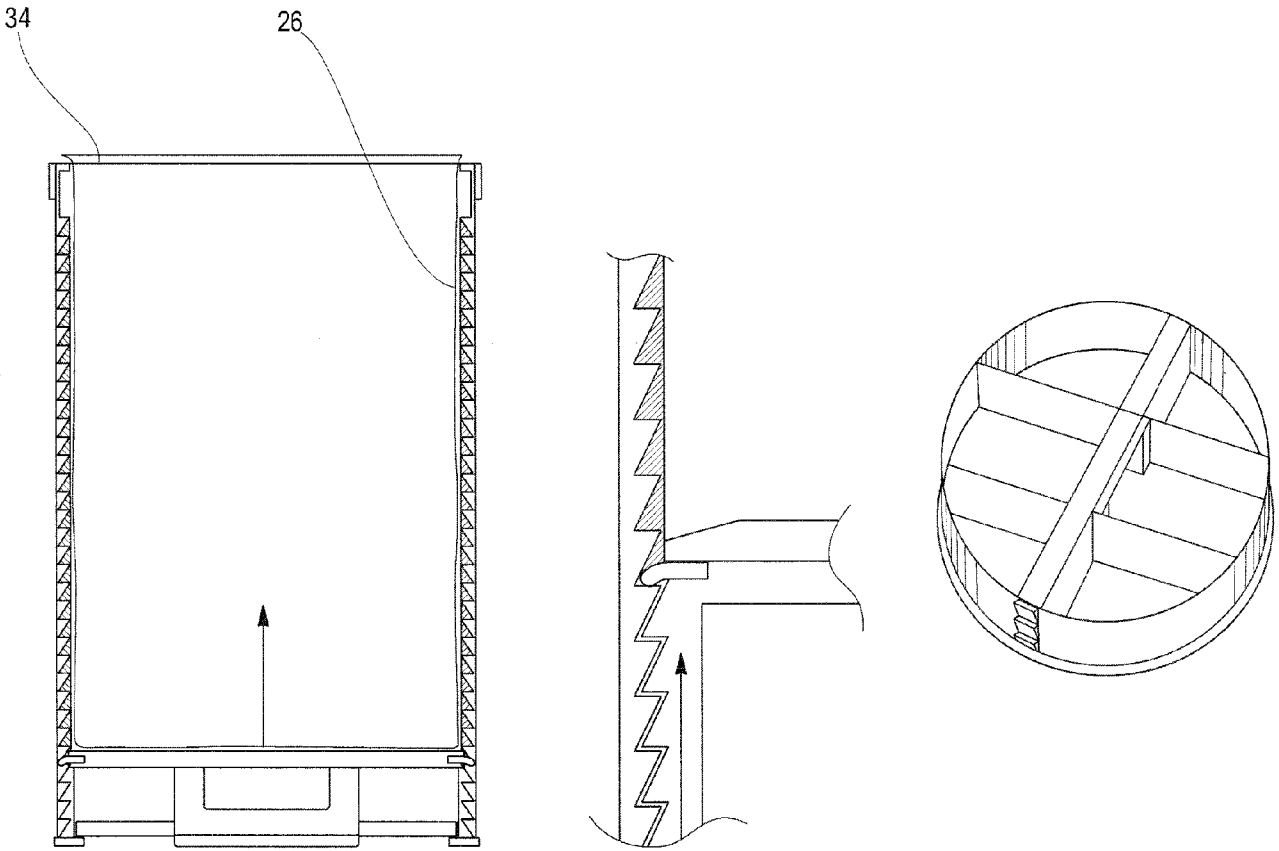
Figure 14:
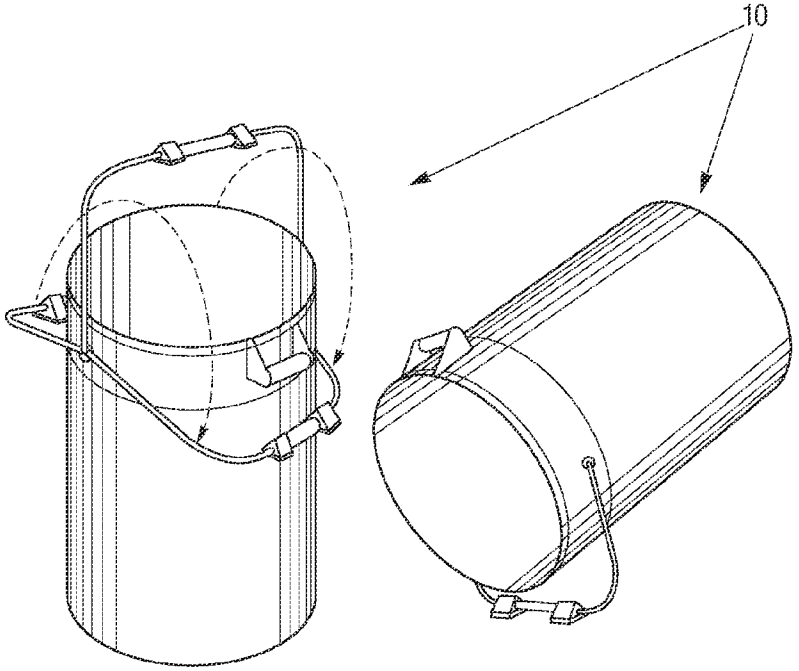

The container has an inner chamber 20, shown in FIG. 6, which includes both an upper inner chamber and lower inner chamber. The inner chamber extends from a top end of the container to a bottom end of the container. A dispensing opening is defined at the top end 14 of the container. In one embodiment, a liner may be provided within the inner chamber. For example, the liner may engage the surface of the inner chamber. In another embodiment, the liner may be made of a variety of materials including plastic. FIGS. 11 and 13 show the container before it has been filled with a product, with the liner extending over the surface of the inner chamber of the container.

A product reservoir is defined within the inner chamber 20 by the liner and the bottom plate 22, which is described in more detail below. The product reservoir can be filled with a dispensable product 11, and then a lid 12 can cover the dispensing opening.

Figure 8:
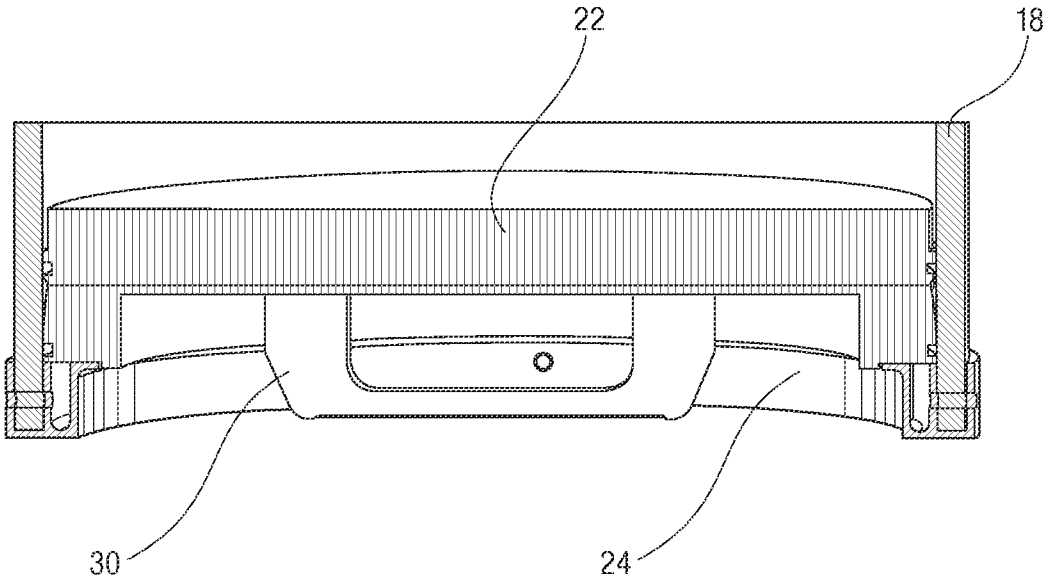
FIG. 8 is a sectional view of the bottom plate engaging the retaining ring near the lower end of the container.
Figure 9:
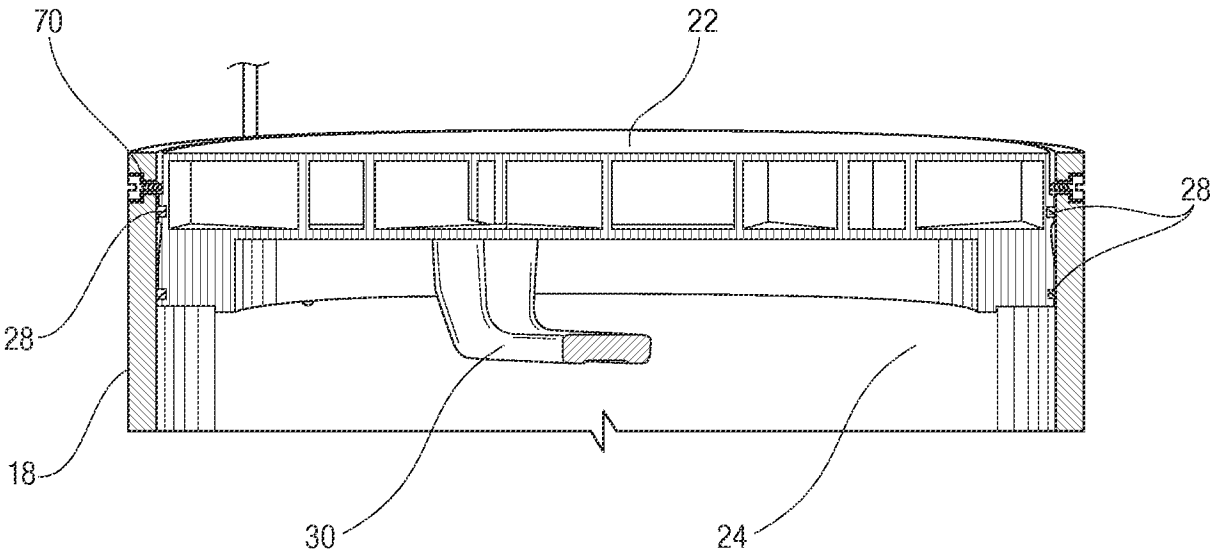
FIG. 9 is a sectional view with the movable bottom plate flush with the upper end of the container.
Figure 10:
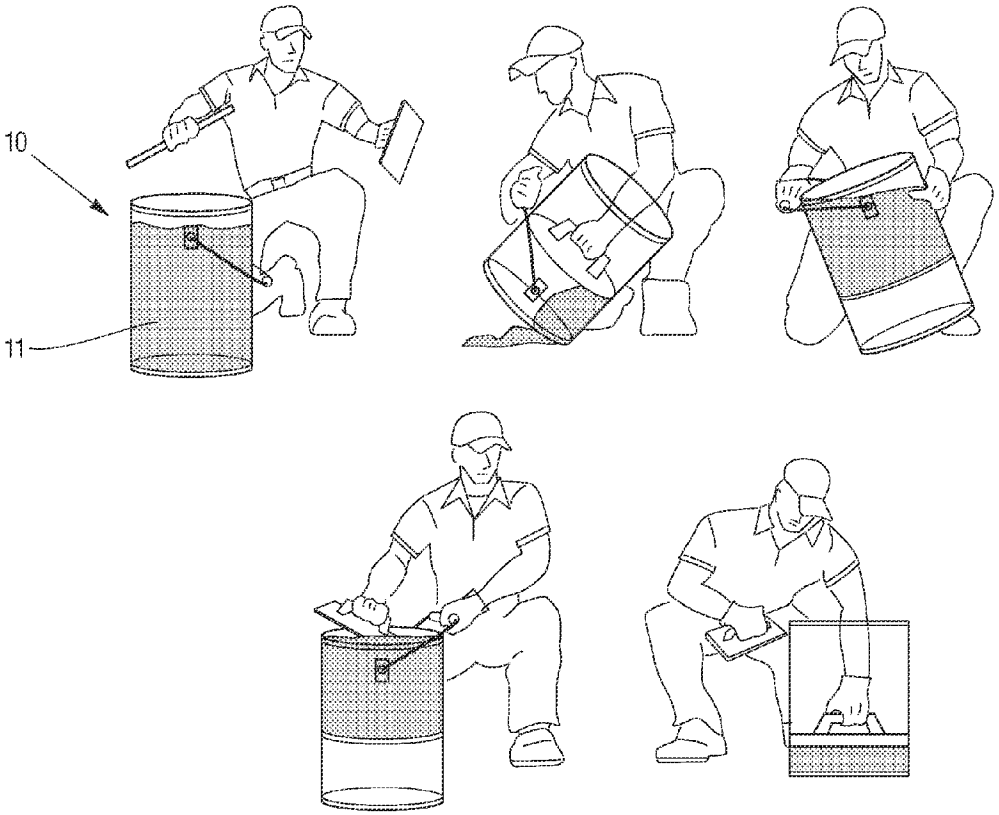
FIG. 10 is an artistic rendering of a second embodiment of the present invention in use.

When the container 10 is filled with a product 11 by the manufacturer, the bottom plate 22 is in an initial position with the bottom plate 22 resting on or engaging the retaining ring 24 at a lower portion of the container. FIG. 8 shows the container in a configuration with the bottom plate 22 at the lower end 16 of the container 10, with the container ready to be filled with a product. The bottom plate is then movable upwardly from the retaining ring 24, along the inner surface of the inner chamber 20, and to the top end 14 of the container when the product has been fully dispensed from the container. FIG. 9 shows the bottom plate 22 being flush with a top end 14 of the container 10, so that no product is stored within the container. Thus, the volume of the product reservoir within the container can be changed by movement of the bottom plate.

Figure 12:
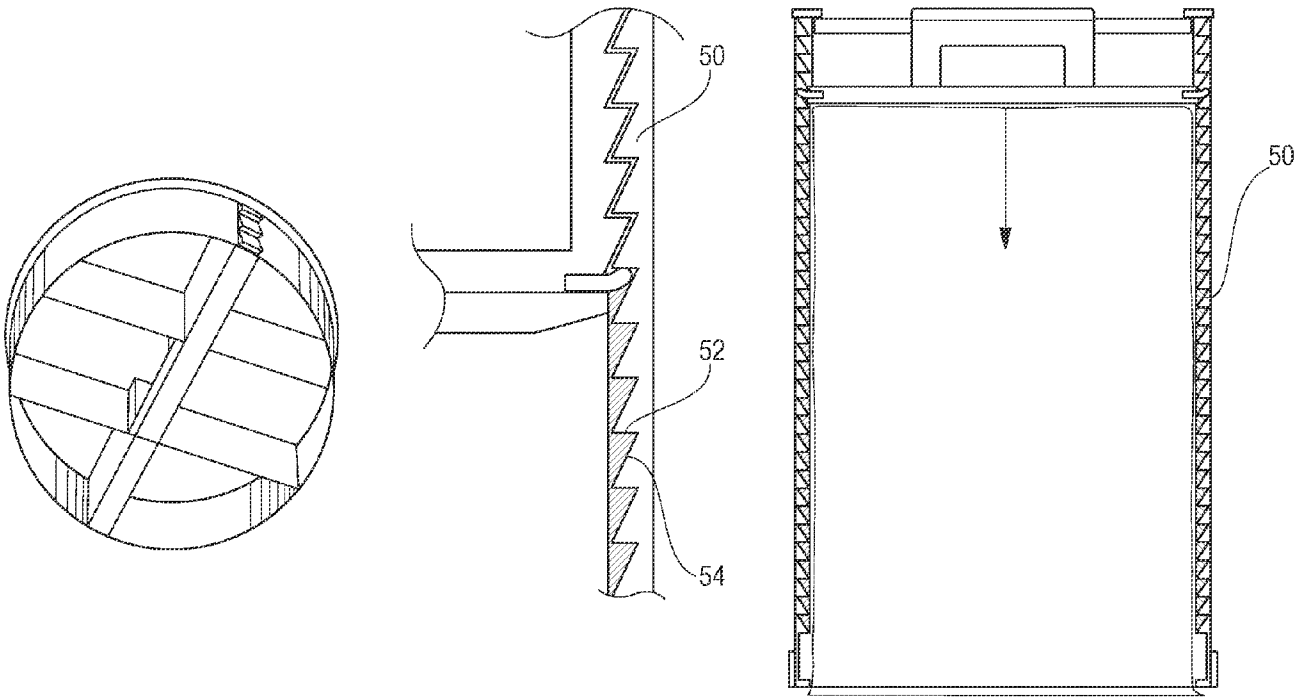

FIGS. 11-13 show how the liner separates the surface of the inner chamber from the product. The liner 26 improves the seal of the bottom plate 22 with the surface of the inner chamber 20, and it helps keep the dispensable product out of the notches formed in the surface of the inner chamber, which are discussed in more detail below.

The bottom plate is movable and configured for slidably engaging an inner surface of the inner chamber between the retaining ring or bottom end of the container and an upper portion of the container or top end of the container. The bottom plate may include one or more bottom plate members. To facilitate engagement of the bottom plate with the inner surface of the inner chamber, the bottom plate includes one or more O-rings 28. For example, if the bottom plate has two bottom plate members, then two O-rings, one for each bottom plate member, may be used in the present invention. The O-rings are seated in a groove along the peripheral edge of the bottom plate. The O-rings are compressed between the bottom plate and the liner that extends over the inner surface of the inner chamber. This provides a seal between the bottom plate and the inner surface of the inner chamber, to prevent leakage of the dispensable product between the O-ring and the liner as the bottom plate is advanced upwardly within the inner chamber. FIG. 9 shows O-rings 28 engaging the inner surface of the inner chamber in an embodiment that does not have the liner.

In one embodiment, the bottom plate 22 is a plunger with a handle 30 connected thereto to facilitate moving the bottom plate from a lower portion of the container to an upper portion of the container. In another embodiment, the plunger handle 30 may depend downwardly from a bottom surface of the bottom plate. Alternatively, it should be noted that the bottom plate may be removable by force, whereby the plate exits the container if suitable for the user. By removing the bottom plate, this may facilitate easier waste or recycling of the container itself.

The container has an aperture at a bottom end to facilitate easy access to the bottom plate. The retaining ring 24 is an annular ring, and the aperture is defined by an inner peripheral edge 32 of the retaining ring 24. In one embodiment, the bottom plate has a diameter smaller than then diameter of the container.

Once the user removes product from the container and is ready to store the container, the user may seal the dispensing opening and then reduce the amount of air in the container. First, the user places the lid 12 over the dispensing aperture 34 of the container. Then, the user inverts the container. Next, the user removes a vent cap from the vent 40 on the bottom plate. Then, the user advances the bottom plate toward the upper end of the container by reaching through the aperture at the lower end of the container and pushing the bottom plate towards the upper end of the container. As the bottom plate moves towards the upper end of the container, it compresses the product and air between the bottom plate and the cap of the container. Air is expelled from the container through the bottom plate vent. Once the user is satisfied that enough air has been expelled, or when product begins to enter the vent, the user secures the vent cap to the vent, and turns the container upright. The container is now ready to be stored until the product is needed again. Because the air has been substantially or entirely expelled from the container, the present container reduces the risk that the product within the container will dry or be otherwise damaged by air exposure between uses. Thus, the product will have a longer shelf-life. This is particularly useful for users who are likely to wait a long time between uses of a product.

Figure 7:
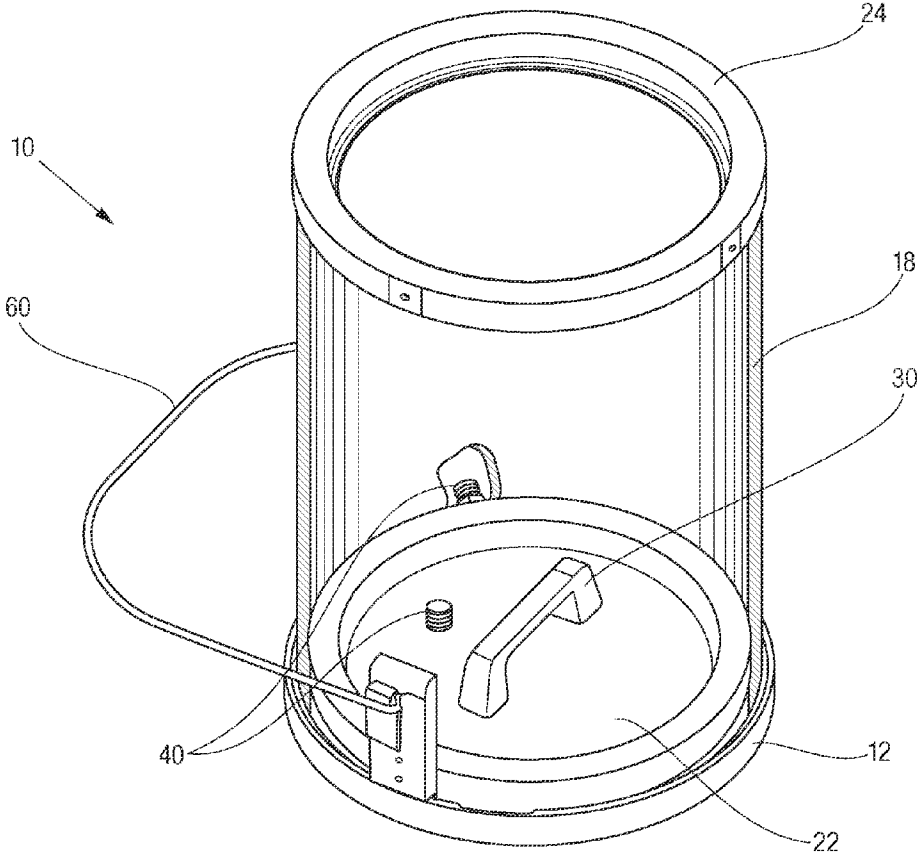
FIG. 7 is a perspective view with the container in transparent view to show the movable bottom plate.

The bottom plate 22 may also include multiple valves/vents 40 or air release mechanisms situated within the bottom plate to allow the escape of air when the bottom plate is plunged towards to upper chamber or top end. Furthermore, the container may include another aperture, valve, or air release mechanism near the upper chamber to allow the escape of air when the bottom plate is plunged toward the upper chamber or top end. FIG. 7 shows a vent 40 on the bottom plate 22 and a vent 40 on the outer wall 18. The valves/vents 40 are separately formed from the dispensing opening. The container can be oriented so that the flowable product within the container settles away from the valve and so that air within the dispensing reservoir is adjacent the valve, such as when the container is substantially sealed by the cap, and the container is inverted as described above. Compression of the contents of the dispensing reservoir then causes air to escape through the open valve or valve.

Figure 17:
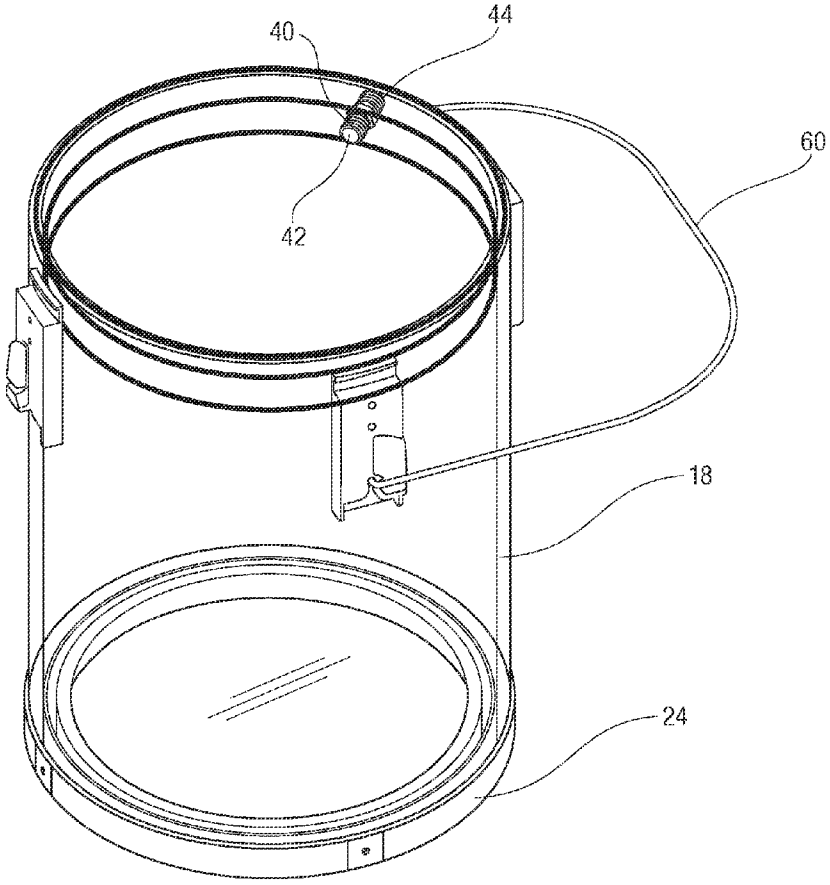
FIG. 17 is an artistic rendering of the container in transparent view showing the valve or aperture situated therein.

A valve formed in the outer wall of the container allows a user to expel air from the dispensing reservoir without inverting the container. The valve on the outer wall has an inner port 42 that extends through the liner, and an outer port 44 extending outwardly from the outer wall of the container. The inner port and outer port are connected by an air path extending through the valve, and are shown in FIG. 17 without the liner.

The container is also useful for those who frequently use a product, but do not use the entire volume of the container in a single use. For these users, they may only need to dispense some of the product from the container, and they may use a tool to reach in the container to access the product. As product is emptied from a conventional container with a fixed bottom wall, it becomes increasingly difficult to access the remaining product in the container with each subsequent use. A user may find it difficult to extend a tool into the container, and product remaining on the wall of the container may be transferred to the user's arms. In contrast, the container of the present invention allows the user to advance the bottom plate towards the upper end of the container as product is removed from the container. This makes the product easy to reach, from the first volume of product dispensed from the container to the last.

The bottom plate can also be advanced towards the upper end of the container to extrude product from the container. This allows a user to dispense a product without having to shake the container or scrape down the interior wall of the container to dispense all of the product within the container.

As the bottom plate is moved towards the upper end of the container, a ratcheting mechanism allows the bottom plate to be firmly seated within the container at various heights. A user can move the bottom plate 22 from the lower inner chamber to the upper inner chamber in a single continuous motion, or in small increments, by pushing against the lower surface of the bottom plate. The O-ring 28 around the outer peripheral edge of the bottom plate passes over a ratcheting mechanism 50 on the wall 18. The ratcheting mechanism may be notches formed along the inner wall of the container, the notches being tapered so that each notch has a flat upper wall 52 and an adjacent side wall 54 that tapers downwardly and outwardly. Thus, the O-ring is compressed as it is pushed past the part of the notch that extends radially inwardly the furthest. Then, the O-ring expands and is seated on the flat upper wall of the notch.

Notches may also be formed on the outer surface of the bottom plate 22.

Because of the design of the bottom plate, inner wall, and ratchet mechanism, a user can dispense product from the container or expel air from the container in a single continuous motion of pushing the bottom plate towards the upper end of the container. This is a significant advantage over a bottom plate that is advanced by a screw mechanism, in which the user has to adjust their grip as the screw mechanism rotates relative to the container. It is also a much faster procedure, making it more convenient for users.

Figure 15:
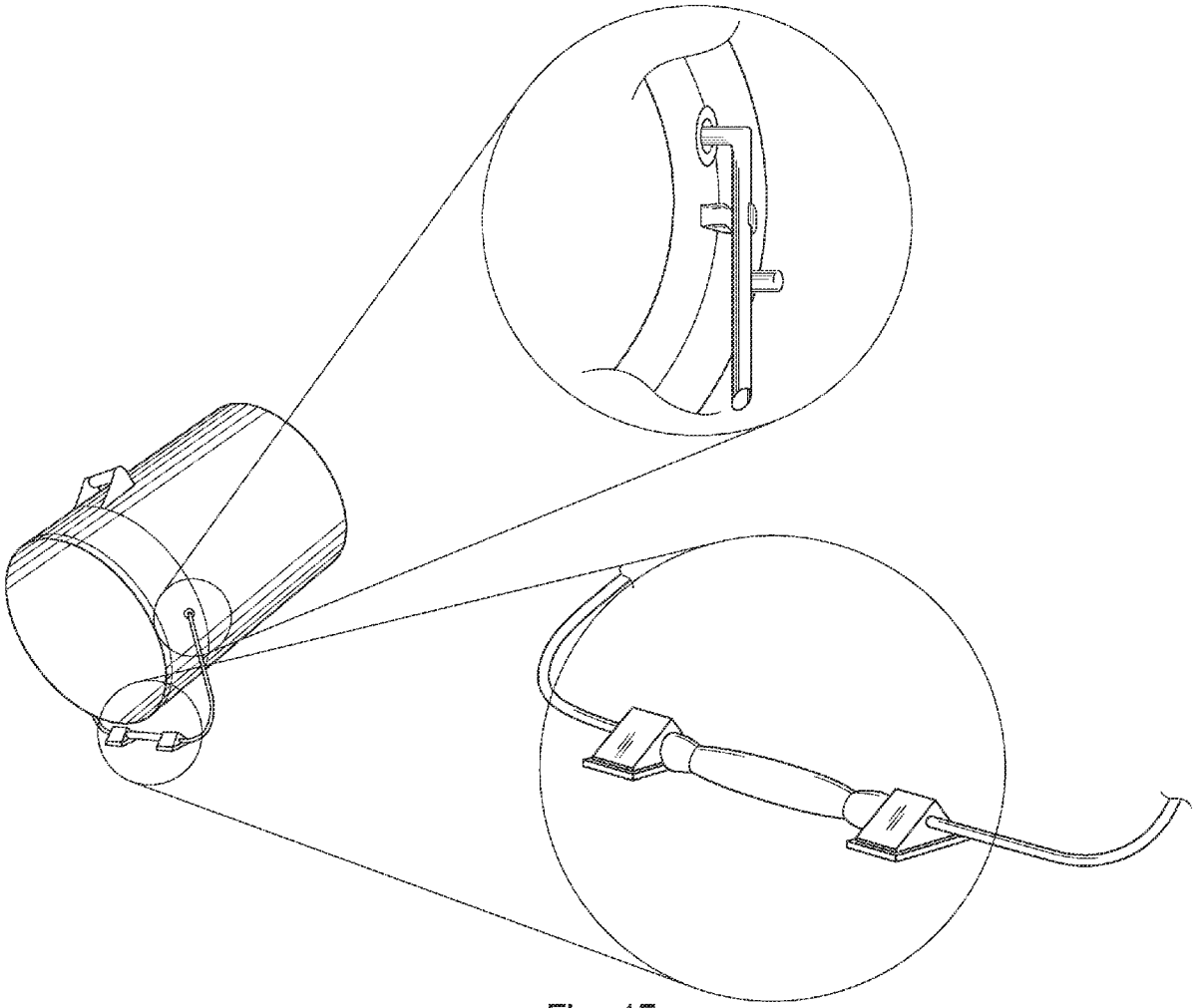
Figure 16:
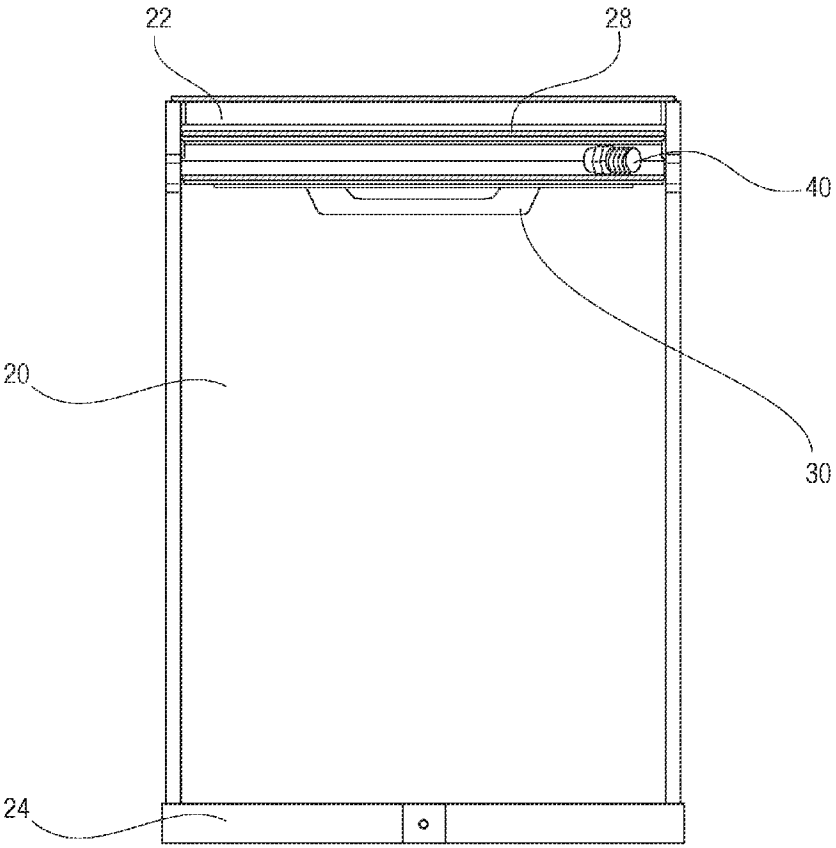
FIG. 16 is another view of the container in transparent view showing the O-rings situated on the bottom plate.

The container may have a handle 60, such as a wire handle, connected to an exterior or interior of the container at an upper portion which provides support. In addition, the container may have a kickstand at one end of the container. The kickstand may reverse the slope of the container when the kickstand is moved to a position in which it can engage a surface to support the container. FIG. 15 shows a handle having a traditional free spinning handle grip 80 and padded and weighted stabilizing outriggers 82. The handle 60 can be rotationally locked with respect to the container by a handle locking system 84. The handle locking system may frictionally engage the handle or otherwise releasably secure it with respect to the container. When the handle is locked, it may be used to support the container when dispensing the product as shown in FIG. 15.

In one embodiment, a catch mechanism 70 is situated near an upper portion of the container to lock flush the bottom plate to top end of the container to form an even surface at top end of the container and top surface of the bottom plate to facilitate material to be extruded from the container. The catch mechanism 70 extends inwardly from the inner surface of the outer wall 18 in FIG. 9. In one embodiment, the catch mechanism may be one or more channel members formed in the container wall. For example, there maybe four channel members formed on the interior of the container to facilitate locking in place the bottom plate to the top of the container. In the locked position, the bottom plate is received within the channels in the container wall. In addition, the channel members may incorporate the catch mechanism and a handle mechanism for locking in place the exterior handle of the container.

In use, the bottom plate moves from the lower inner chamber of the container to the upper inner chamber to remove material from an interior of the container to an exterior of the container. The method of extruding material from the inner chamber of an open or sealed container by motioning the releasable bottom plate in the opposite direction of the lower portion of the container may include the following steps. First, material is provided within the container to be pushed out of the chamber by use of the of bottom plate by a force provided by a human or other mechanical means. Second, the bottom plate slides from the lower portion to the top portion of the container to extrude or remove the material from the sides and bottom of the container. Third, a catch mechanism located near the upper portion of the container locks the plate flush to the top end of the container to form an even surface at to the top end of the container and upper surface of the bottom plate for the material to be extruded or removed from an interior of the container to an exterior of the container. Of course, it is contemplated that the container may be sealed or open at the top end and bottom ends of the container.

It should be noted that the material of the container may be cardboard, plastic, or any other material that would facilitate the design of the container and its components as provided above.

It can therefore be seen that the container of the present invention has a bottom plate that is movable and slidably engages an interior surface of the container to facilitate convenient and easy access and removal of material from the container. The bottom plate engages a ratcheting mechanism along the interior wall of the container so that the bottom plate can be supported at various heights within the container. The movable bottom plate allows a user to reduce the air volume within the container after some of a product has been dispensed from the container. The container has vents that are separate from the dispensing opening, and independently sealable from the sealable dispensing opening, so that the dispensing aperture may be sealed to contain the dispensable product within the container while air is vented from the container. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A container, comprising:

the container having an upper portion of the container and a retaining ring at a lower portion of the container;

the container having an inner chamber, the inner chamber having an upper inner chamber and lower inner chamber;

a bottom plate configured for slidably engaging a surface of the inner chamber between the retaining ring and an upper portion of the container, the container having an aperture at a bottom end to facilitate access to the bottom plate, the bottom plate having a diameter smaller than the diameter of the container;

a ratcheting mechanism on an inner wall of the inner chamber, the ratcheting mechanism being configured and arranged to allow the bottom plate to be firmly seated within the container at various heights;

a catch near the upper portion of the container to lock flush the bottom plate to top end of the container to form an even surface at top end of the container and top surface of the bottom plate to facilitate material to be extruded from the container;

wherein the bottom plate is a plunger with a handle connected thereto;

whereby the bottom plate moves from a lower inner chamber of the container to an upper inner chamber to remove material from the container.

2. The container of claim 1, wherein the upper portion of the container has a lid.

3. The container of claim 1, wherein the ratcheting mechanism is notches formed along the inner wall of the container, and the bottom plate is configured to engage one or more of the notches to firmly seat the bottom plate at one of various heights within the container.

4. The container of claim 1, the container further comprising:

at least one vent defined in the bottom plate, the at least one vent allowing air to be expelled from the container, each vent having a vent cap so that the respective vent can be selectively sealed.

* * * * *